US009765774B2

(12) United States Patent
Terashima et al.

(10) Patent No.: US 9,765,774 B2
(45) Date of Patent: Sep. 19, 2017

(54) INTERNAL GEAR PUMP

(71) Applicant: AISIN SEIKI KABUSHIKI KAISHA, Kariya-shi (JP)

(72) Inventors: Hirohito Terashima, Anjo (JP); Fumihiko Toyoda, Nagakute (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 62 days.

(21) Appl. No.: 14/391,556

(22) PCT Filed: May 24, 2013

(86) PCT No.: PCT/JP2013/064484

§ 371 (c)(1),
(2) Date: Oct. 9, 2014

(87) PCT Pub. No.: WO2013/180033

PCT Pub. Date: Dec. 5, 2013

(65) Prior Publication Data

US 2015/0064038 A1 Mar. 5, 2015

(30) Foreign Application Priority Data

Jun. 1, 2012 (JP) ..... 2012-126373

(51) Int. Cl.
*F01C 1/10* (2006.01)
*F03C 2/08* (2006.01)
(Continued)

(52) U.S. Cl.
CPC ..... *F04C 2/103* (2013.01); *F04C 2/086* (2013.01); *F04C 2/102* (2013.01);
(Continued)

(58) Field of Classification Search
CPC ..... F04C 2/082; F04C 15/0088; F04C 2/102; F04C 2/103
(Continued)

(56) References Cited

U.S. PATENT DOCUMENTS 2,434,135 A * 1/1948 Witchger ..... F04C 2/102 418/130
2,522,824 A * 9/1950 Hicks ..... F01C 21/0809 418/111
(Continued)

FOREIGN PATENT DOCUMENTS

CN 2348150 Y 11/1999
CN 201129295 Y 10/2008
(Continued)

OTHER PUBLICATIONS

Machine English translation by Japan Platform for Patent Information fo Japanese Patent Publication 2012-057561, Feb. 2016.*
(Continued)

*Primary Examiner* — Deming Wan
(74) *Attorney, Agent, or Firm* — Buchanan Ingersoll & Rooney PC

(57) ABSTRACT

An internal gear pump includes a housing having a pump chamber in which an inner rotor and an outer rotor are arranged. A suction port in communication with a suction path and a discharge port in communication with a discharge path are formed at the housing. The pump chamber includes an inner wall having a suction region at a suction port-side and a discharge region at a discharge port-side. The suction region includes a first suction region extending towards the suction path from a pressing point, where the outer rotor is pressed when the internal gear pump is in operation, and a second suction region between the first suction region and the discharge region. A groove that enlarges a clearance between the outer rotor and the inner wall is formed in the first suction region, but the groove is not formed in the second suction region.

4 Claims, 8 Drawing Sheets

(51) Int. Cl.

| | |
|---|---|
| ***F04C 2/08*** | (2006.01) |
| ***F04C 18/08*** | (2006.01) |
| ***F01C 1/08*** | (2006.01) |
| ***F04C 15/06*** | (2006.01) |
| ***F04C 2/10*** | (2006.01) |
| ***F04C 15/00*** | (2006.01) |

(52) U.S. Cl.
CPC ..... *F04C 15/0088* (2013.01); *F04C 2240/54* (2013.01); *F04C 2240/56* (2013.01)

(58) Field of Classification Search
USPC ..... 418/161, 171, 108, 206.4, 132
See application file for complete search history.

(56) References Cited

U.S. PATENT DOCUMENTS

| | | | | |
|---|---|---|---|---|
| 6,419,469 | B1 * | 7/2002 | Shulver ..... | F04C 2/102 418/15 |
| 2008/0017437 | A1 | 1/2008 | Kurata | |
| 2009/0196772 | A1 | 8/2009 | Watanabe et al. | |

FOREIGN PATENT DOCUMENTS

| | | | |
|---|---|---|---|
| JP | 63-195391 | A | 8/1988 |
| JP | H08-312539 | A | 11/1996 |
| JP | 2003-035277 | A | 2/2003 |
| JP | 2004-028005 | A | 1/2004 |
| JP | 3801536 | B2 | 5/2006 |
| JP | 4600612 | B2 | 12/2010 |
| JP | 4792342 | B2 | 7/2011 |
| JP | 2012-057561 | A | 3/2012 |

OTHER PUBLICATIONS

International Search Report (PCT/ISA/2l0) mailed on Aug. 27, 2013, by the Japanese Patent Office as the International Searching Authority for International Application No. PCT/JP2013/064484.

Office Action (The First Office Action) issue on Dec. 24, 2015, by the State Intellectual Property Office of The People's Republic of China in corresponding Chinese Patent Application No. 201380027045.1, and an English Translation of the Office Action. (10 pages).

* cited by examiner

INTERNAL GEAR PUMP

TECHNICAL FIELD

This invention relates to an internal gear pump.

BACKGROUND ART

A known internal gear pump includes a housing having a pump chamber, an inner rotor having external teeth on its outer end and arranged in the pump chamber, an outer rotor, whose rotational axis differs from the inner rotor, having internal teeth on its inner end and arranged in the pump chamber, a suction port that is in communication with the pump chamber and supplies a fluid thereto, a suction path in communication with the suction port, a discharge port that is in communication with the pump chamber and discharges the fluid therefrom, and a discharge path in communication with the discharge port, wherein a groove for generating a discharge pressure in a direction such as to negate a force applied to the outer rotor is formed at an inner wall at a location close to the discharge port (see for example the Patent Document 1).

Another known internal gear pump includes a housing having a pump chamber, an inner rotor having external teeth on its outer end and arranged in the pump chamber, an outer rotor, whose rotational axis differs from the inner rotor, having internal teeth on its inner end and arranged in the pump chamber, a suction port that is in communication with the pump chamber and supplies a fluid thereto, a suction path in communication with the suction port, a discharge port that is in communication with the pump chamber and discharges the fluid therefrom, and a discharge path in communication with the discharge port, wherein a groove for supplying the fluid to an outer circumference of the outer rotor is provided at an inner wall of the pump chamber at a location extending along the suction port (see for example the Patent Document 2).

CITATION LIST

Patent Literature

Patent Document 1: JP2004-28005A
Patent Document 2: JP2012-57561A

SUMMARY OF INVENTION

Technical Problem(s)

However, because the internal gear pump disclosed in the Patent Document 1 includes the groove for negating the force applied to the outer rotor at the inner wall at the location close to the discharge port, the rotational axis of the outer rotor is located in the vicinity of the center of the pump chamber and therefore behavior of the outer rotor becomes unstable, which may result in generating phenomena such as oil whirl (a phenomenon in which the outer rotor whirls, which occurs when the thickness of an oil film between the housing and the outer rotor becomes thin due to a pressing force of the fluid applied to the outer rotor and the like).

According to the internal gear pump disclosed in the Patent Document 2, the thickness of the oil film is increased by supplying the fluid to the outer circumference of the outer rotor in order to avoid seizure of the outer circumference of the outer rotor. However, because the groove is widely formed on the inner wall of the pump chamber at the location extending along the suction port, the fluid that should be discharged from the discharge path may leak into the groove, which may result in deteriorating discharge performance of the pump.

The present invention was made in consideration with the above drawbacks and an object of the invention is to avoid discharge performance of a pump from deteriorating, increase the thickness of an oil film and stabilize behavior of an outer rotor.

Solution to Problem

The structure of the internal gear pump associated with the invention made for solving the above problem is characterized in that an internal gear pump includes a housing having a pump chamber, an inner rotor arranged in the pump chamber, rotating about a first rotational axis and having external teeth on its outer end, an outer rotor arranged in the pump chamber, rotating about a second rotational axis and having internal teeth on its inner end, a suction port that is formed at the housing and through which a fluid is sucked into the pump chamber, a discharge port that is formed at the housing and through which the fluid is discharged from the pump chamber, a suction path in communication with the suction port, and a discharge path in communication with the discharge port, wherein the pump chamber includes an inner wall extending in a rotating direction of the outer rotor, the inner wall includes a suction region located close to the suction port with respect to a boundary, which is a plane including the first rotational axis and the second rotational axis, and a discharge region located close to the discharge port with respect to the boundary, the suction region includes a first suction region extending in a circumferential direction towards the suction path from a pressing point, which is located at a position in the suction region and where the outer rotor is pressed when the internal gear pump is in operation, and a second suction region located between the first suction region and the discharge region, a groove that enlarges a clearance between the outer rotor and the inner wall is provided at least at a portion of the first suction region, and the groove is not provided in the second suction region.

DESCRIPTION OF EMBODIMENTS

FIGS. 1 to 8 illustrate an internal gear pump 1 installed in a lubricating oil supply system of a vehicle.

Figure 1:
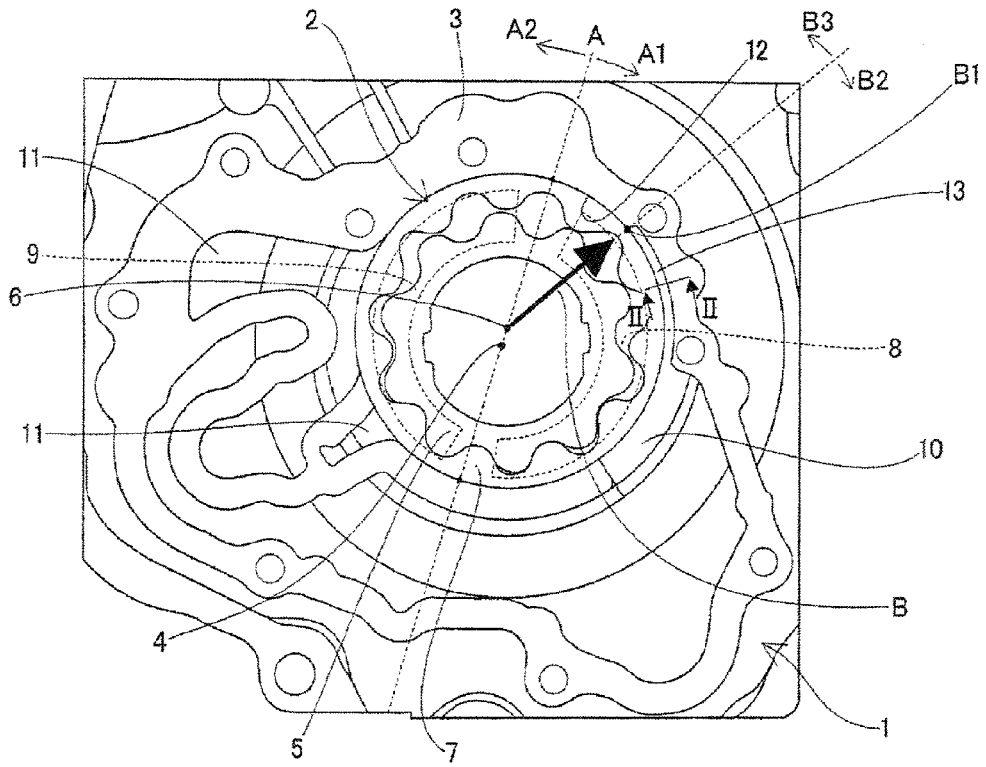
FIG. 1 A front view illustrating an internal gear pump according to an embodiment of the invention.

A configuration of the internal gear pump 1 according to an embodiment of the invention will be described below. FIG. 1 is a front view of the internal gear pump 1 according to the embodiment of the invention. As illustrated in FIG. 1, the internal gear pump 1 of the invention includes a housing 3 having a pump chamber 2, an inner rotor 5 that is arranged in the pump chamber 2, rotates about a first rotational axis 4 and includes external teeth on its outer end, an outer rotor 7 that is arranged in the pump chamber 2, rotates about a second rotational axis 6 and includes internal teeth on its inner end, a suction port 8 that is formed at the housing 3 and through which an oil is sucked into the pump chamber 2, a discharge port 9 that is formed at the housing 3 and through which the oil is discharged from the pump chamber 2, a suction path 10 in communication with the suction port 8, and two discharge paths 11 in communication with the discharge port 9.

The pump chamber 2 includes an inner wall 12 in a perfect circle-shape extending in a rotating direction of the outer rotor 7. With a plane A including the first rotational axis 4 and the second rotational axis 6 as a boundary, the inner wall 12 has a suction region A1 located close to the suction port 8 with respect to the boundary and a discharge region A2 located close to the discharge port 9 with respect to the boundary.

The outer rotor 7 is pressed in a direction of a vector B from the second rotational axis 6 by a resultant force of an inter-teeth pressure generated between the external teeth of the inner rotor 5 and the internal teeth of the outer rotor 7, a pressure applied from the discharge port 9, and a driving force of the inner rotor 5. The suction region A1 has a first section region B2 that extends in a circumferential direction towards the suction path 10 from a pressing point B1 located in the suction region A1 at a position where the outer rotor 7 is pressed when the internal gear pump 1 is in operation, and a second suction region B3 located between the first suction region B2 and the discharge region A2. A groove 13 is formed in the first suction region B2 so as to extend in an axial direction relative to the second rotational axis 6 and so as to extend from the suction path 10 to the pressing point B1 in order to establish a connection therebetween and enlarge a clearance between the outer rotor 7 and the inner wall 12. On the other hand, the groove 13 is not formed in the second suction region B3. The outer rotor 7 contacts the inner wall 12 via an oil film in the second suction region B3. It is sufficient as long as the groove 13 is formed at a portion of the first suction region B2.

Figure 2:
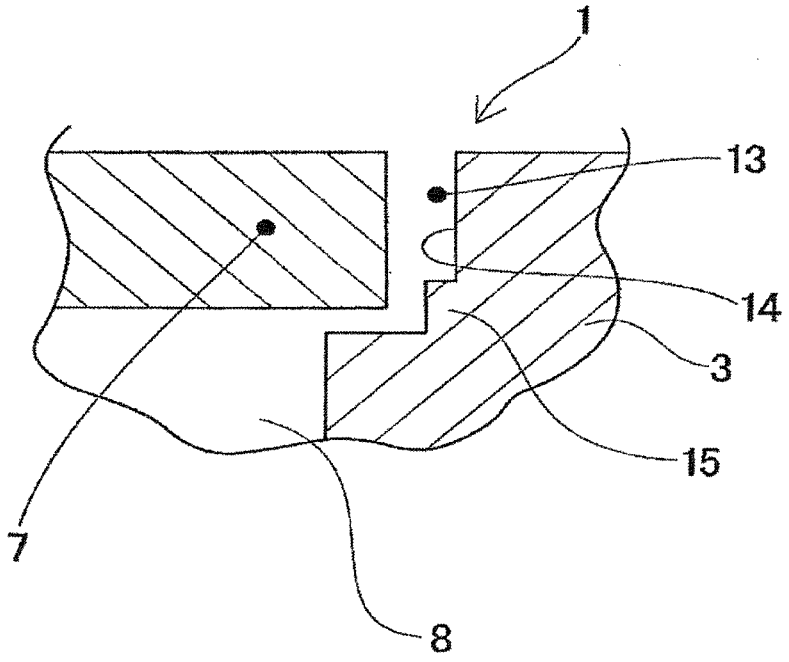
FIG. 2 A cross-sectional view of the internal gear pump according to the embodiment of the invention taken along the line II-II in FIG. 1.

FIG. 2 is a cross-sectional view of the internal gear pump 1 according to the embodiment of the invention taken along the line II-II in FIG. 1. As illustrated in the cross-sectional view taken along the line II-II where the groove 13 is formed, a stepped portion 15 is formed so as to extend from a circumferential bottom portion 14 of the inner wall 12 where the groove 13 is formed (i.e. a groove inner wall) towards the outer rotor 7.

In other words, the clearance extends in a stepwise shape towards a circumference of the inner wall 12, more specifically, from the suction port 8, the stepped portion 15 and to the bottom portion 14. The outer rotor 7 contacts the stepped portion 15 via the oil film.

An operation of the internal gear pump 1 according to the embodiment of the invention will be described below. The oil is supplied to a clearance, that is formed between the external teeth of the inner rotor 5 and the internal teeth of the outer rotor 7 and whose volume changes in a volume increase direction, from the suction path 10 via the suction portion 8 in the suction region A1. The oil sucked in the suction region A1 is discharged from a clearance, that is formed between the external teeth of the inner rotor 5 and the internal teeth of the outer rotor 7 and whose volume changes in a volume decrease direction, to the discharge paths 11 via the discharge port 9 in the discharge region A2. Additionally, the oil permeates through clearances formed at components such as the housing 3, the inner rotor 5, and outer rotor 7, which contact one another via the oil film.

The inner rotor 5 is applied with the driving force and rotates about the first rotational axis 4 in a counterclockwise direction in FIG. 1. The outer rotor 7 is driven by the inner rotor 5 and rotates about the second rotational axis 6 in the counterclockwise direction in FIG. 1. Consequently, the oil is supplied to the clearance formed between the external teeth of the inner rotor 5 and the internal teeth of the outer rotor 7 in the suction region A1, and the oil is discharged from the clearance formed between the external teeth of the inner rotor 5 and the internal teeth of the outer rotor 7 in the discharge region A2.

The outer rotor 7 is pressed in the direction of the vector B from the second rotational axis 6 by the resultant force of the inter-teeth pressure generated between the external teeth of the inner rotor 5 and the internal teeth of the outer rotor 7, the pressure applied from the discharge port 9, and the driving force of the inner rotor 5, and further the outer rotor 7 is pressed against the inner wall 12 towards the pressing point B1.

Advantages of the internal gear pump 1 according to the embodiment of the invention will be explained below.

The resultant force of the inter-teeth pressure generated between the external teeth of the inner rotor 5 and the internal teeth of the outer rotor 7, the pressure applied from the discharge port 9, and the driving force of the inner rotor 5 presses the outer rotor 7 in the direction of the vector B. While in this operation, the groove 13 that enlarges the clearance increases the thickness of the oil film in the first suction region B2, thereby reducing a repellent force generated by the oil film between the outer rotor 7 and the inner wall 12. As the thickness of the oil film increases, the oil film collapses, by which the repellent force is absorbed, thereby reducing the repellent force (the repellent force is weakened because interference by the oil film is great). On the other hand, as the thickness of the oil film decreases, the oil film is less likely to collapse and therefore the repellent force is not absorbed and becomes great. In other words, the thickness of the oil film is inversely proportional to the repellent force. As the clearance between the outer rotor 7 and the inner wall 12 decreases in the direction in which the outer rotor 7 is pressed, the position of the outer rotor 7 with respect to the housing 3 is adjusted, so that behavior of the outer rotor 7 is stabilized, which may result in avoiding phenomena such as the oil whirl of the outer rotor 7 from occurring.

An area where the outer rotor 7 and the inner wall 12 face each other and contact each other via the oil film is secured because the groove 13 is not formed in the second suction region B3. Consequently, a deterioration of discharge performance of the internal gear pump 1, which occurs when the oil that should be discharged from the discharge paths 11 leaks to the groove 13, may be avoided. As a result, the behavior of the outer rotor 7 may be further stabilized.

Since the stepped portion 15 is provided so as to extend from the bottom portion 14 of the groove 13 towards the outer rotor 7, the outer rotor 7 and the stepped portion 15 contact with each other via the oil film, which may result in further stabilizing the behavior of the outer rotor 7. In other words, as the stepped portion 15 is provided at the groove 13, the outer rotor 7 is controlled by the stepped portion 15 via the oil film, which may result in avoiding the whirling of the outer rotor 7 and further, reducing the repellent force, which is generated by the oil film between the outer rotor 7 and the inner wall 12, by the groove 13.

The groove 13 extends in the circumferential direction until reaching the suction path 10 and is directly in communication with the suction path 10, so that even when a foreign substance enters into the groove, the foreign substance may be discharged to the suction path 10.

First Modified Example

Figure 3:
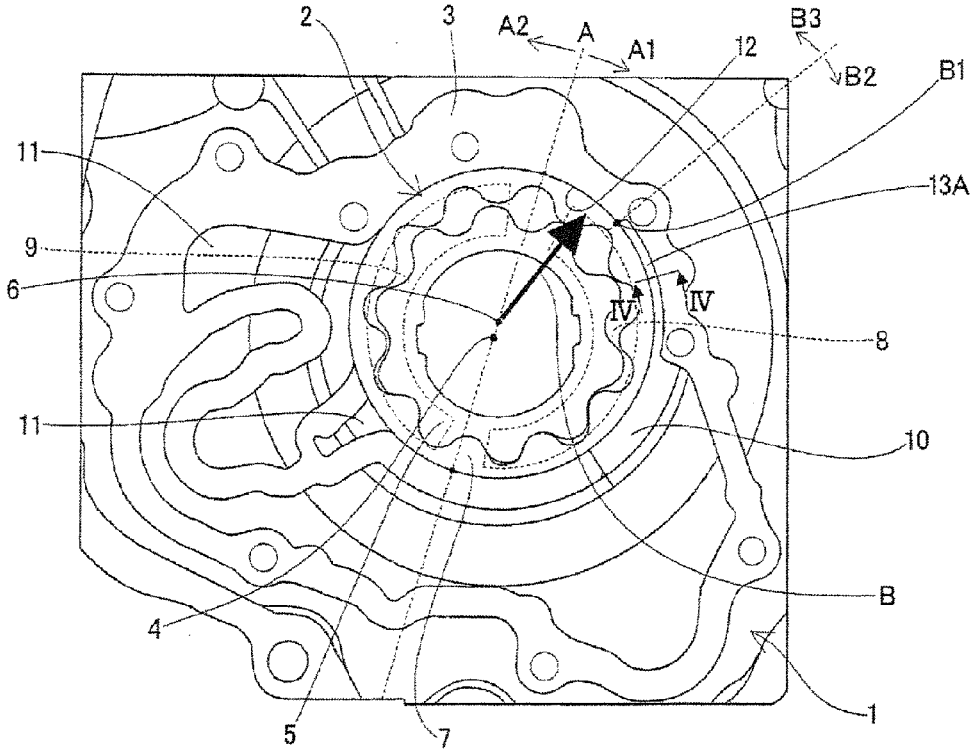
FIG. 3 A front view of the internal gear pump according to a first modified example of the invention.
Figure 4:
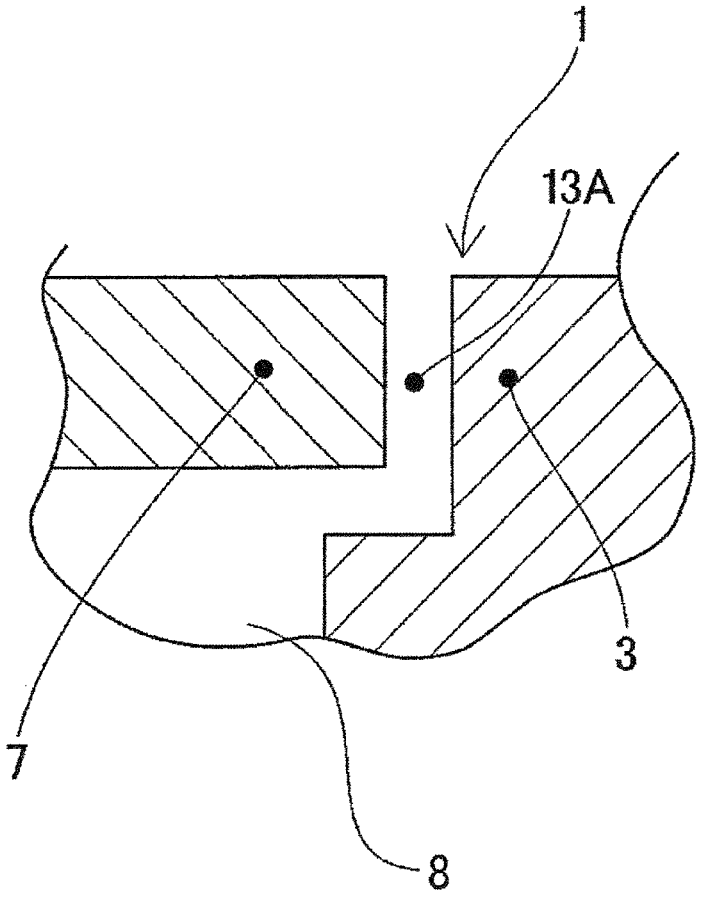
FIG. 4 A cross-sectional view of the internal gear pump according to the first modified example of the invention taken along the line IV-IV in FIG. 3.

A configuration of the internal gear pump 1 according to a first modified example of the embodiment of the present invention will be described below. FIG. 3 illustrates a front view of the internal gear pump 1 according to the first modified example of the invention. FIG. 4 is a cross-sectional view of the internal gear pump 1 according to the first modified example of the invention taken along the line IV-IV in FIG. 3. The first modified example differs from the embodiment illustrated in FIGS. 1 and 2 in that a groove 13A is not formed in the stepwise shape and is directly in communication with the suction port 8.

Advantages of the internal gear pump 1 according to the first modified example of the invention will be described below.

According to the first modified example of the invention, because the groove 13A is directly in communication with the suction port 8, an oil film force generated between the outer rotor 7 and the inner wall 12 may be further decreased. Additionally, even when the foreign substance enters the groove 13A, the foreign substance may be further actively discharged to the suction port 8 and the suction path 10.

Second Modified Example

Figure 5:
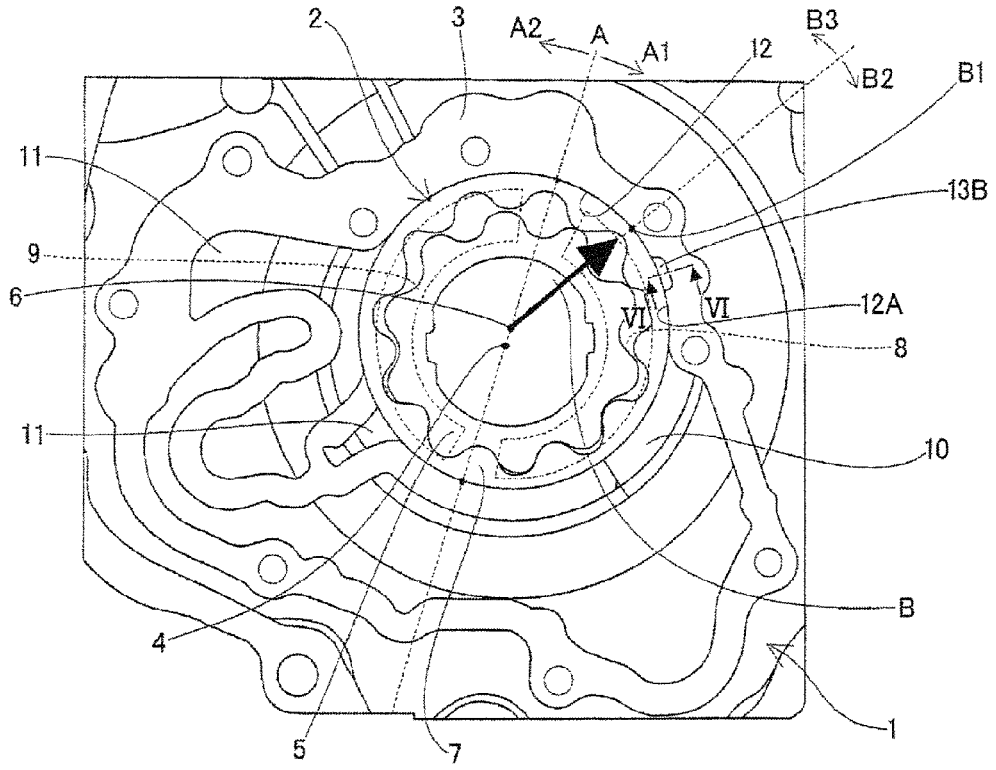
FIG. 5 A front view of the internal gear pump according to a second modified example of the invention.
Figure 6:
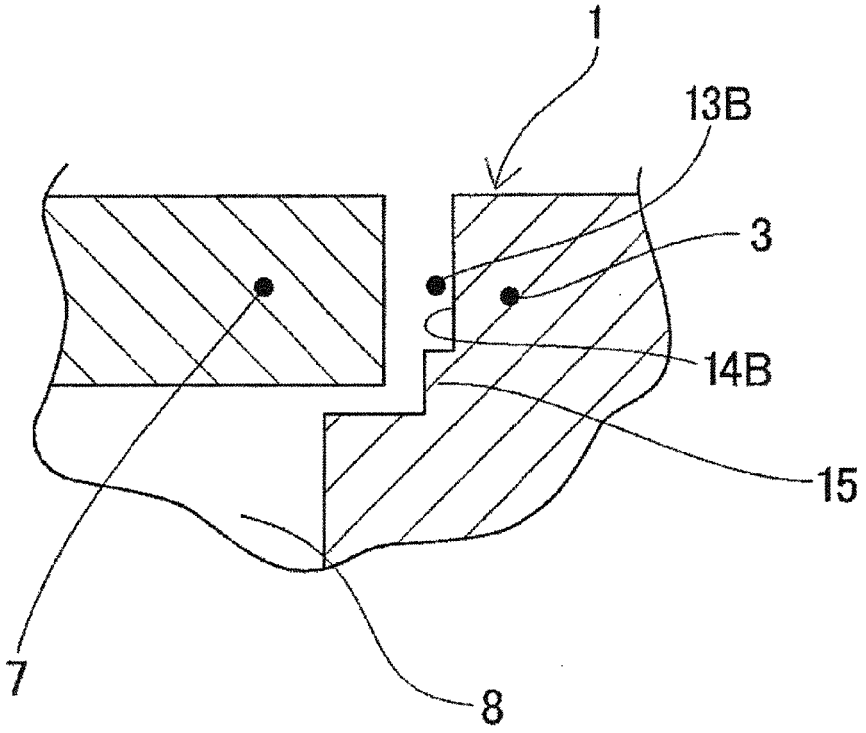
FIG. 6 A cross-sectional view of the internal gear pump according to the second modified example of the invention taken along the line VI-VI in FIG. 5.

Explained below is a configuration of the internal gear pump 1 according to a second modified example of the embodiment of the invention. FIG. 5 is a front view of the internal gear pump 1 according to the second modified example of the embodiment of the invention. FIG. 6 is a cross-sectional view of the internal gear pump 1 according to the second modified example of the embodiment of the invention taken along the line VI-VI in FIG. 5. The second modified example differs from the embodiment illustrated in FIGS. 1 and 2 in that a groove 13B is not extended to reach the suction path 10, the groove 13B is in communication with the suction path 10 via the suction port 8 but is not directly in communication with the suction path 10. In other words, an inner wall 12A, which contacts the outer rotor 7, is provided between the suction path 10 and the groove 13B.

Advantages of the internal gear pump 1 according to the second modified example of the embodiment of the invention will be described below.

According to the second modified example of the embodiment of the invention, because the groove 13B is not directly in communication with the suction path 10, the oil may be retained in the groove 13B and the internal gear pump 1 may be lubricated by using the oil stored in the groove 13B when the oil film is likely to be broken such as when an engine is started, therefore frictional wear of an outer circumference of the outer rotor 7 may be avoided.

Third Modified Example

Figure 7:
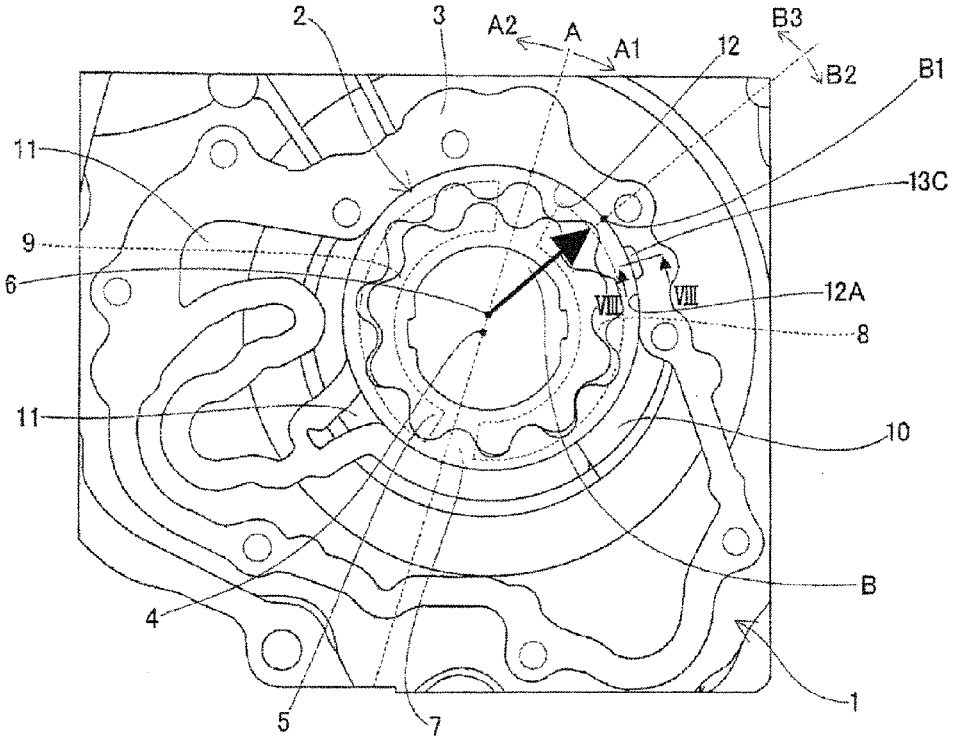
FIG. 7 A front view of the internal gear pump according to a third modified example of the invention.
Figure 8:
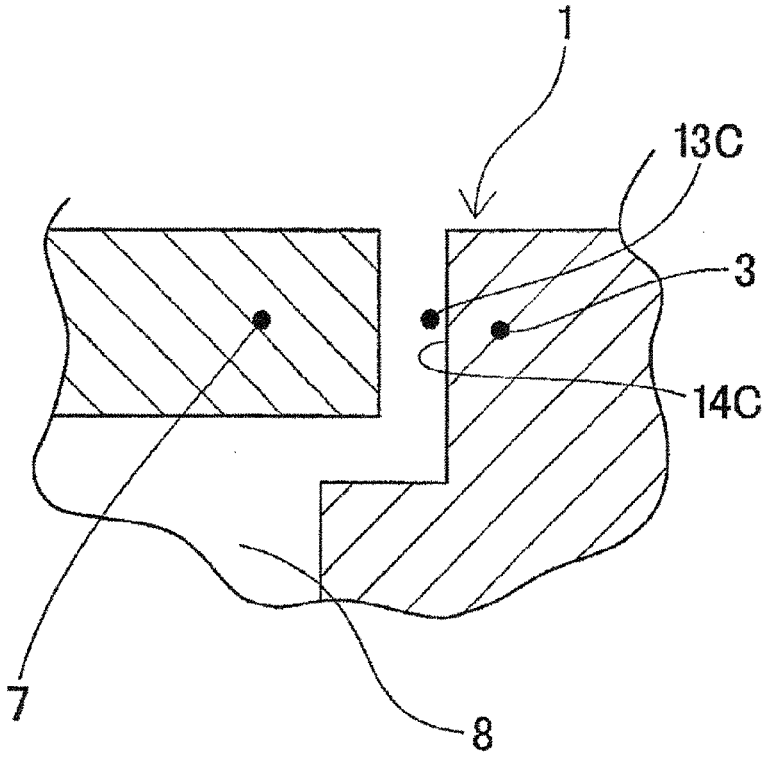
FIG. 8 A cross-sectional view of the internal gear pump according to the third modified example of the invention taken along the line VIII-VIII in FIG. 7.

A configuration of the internal gear pump 1 according to a third modified example of the embodiment of the invention will be described below. FIG. 7 is a front view of the internal gear pump 1 according to the third modified example of the invention. FIG. 8 is a cross-sectional view of the internal gear pump 1 according to the third modified example of the embodiment of the invention taken along the line VIII-VIII in FIG. 7. The third modified example differs from the second modified example illustrated in FIGS. 5 and 6 in that a groove 13C is not formed in a stepwise shape and is directly in communication with the suction port 8.

Advantages of the internal gear pump 1 according to the third modified example of the embodiment of the invention will be described below.

According to the third modified example of the invention, because the groove 13C is directly in communication with the suction port 8, the oil film force generated between the outer rotor 7 and the inner wall 12 may be further reduced when compared to the second modified example. Furthermore, even when the foreign substance enters into the groove 13C, the foreign substance may be further actively discharged to the suction port 8 and the suction path 10.

According to the embodiments, the internal gear pump 1 includes the housing 3 having the pump chamber 2, the inner rotor 5 arranged in the pump chamber 2, rotating about the first rotational axis 4 and having the external teeth on an outer end thereof, the outer rotor 7 arranged in the pump chamber 2, rotating about the second rotational axis 6 and having the internal teeth on an inner end thereof, the suction port 8 that is formed at the housing 3 and through which the oil is sucked into the pump chamber 2, the discharge port 9 that is formed at the housing 3 and through which the oil is discharged from the pump chamber 2, the suction path 10 in communication with the suction port 8, and the discharge path 11 in communication with the discharge port 9, wherein the pump chamber 2 includes the inner wall 12 extending in the rotating direction of the outer rotor 7, the inner wall 12 includes the suction region A1 located close to the suction port 8 with respect to the boundary, which is the plane A including the first rotational axis 4 and the second rotational axis 6, and the discharge region A2 located close to the discharge port 9 with respect to the boundary, the suction region A1 includes the first suction region B2 extending in the circumferential direction towards the suction path 10 from the pressing point B1, which is located at the position in the suction region A1 and where the outer rotor 7 is pressed when the internal gear pump 1 is in operation, and the second suction region B3 located between the first suction region B2 and the discharge region A2, the groove 13, 13A, 13B, 13C that enlarges the clearance between the outer rotor 7 and the inner wall 12 is provided at least at a portion of the first suction region B2, and the groove 13, 13A, 13B, 13C is not provided in the second suction region B3.

According to the internal gear pump 1 of the embodiments, the outer rotor 7 is pressed against the inner wall 12 by the resultant force of the inter-teeth pressure generated between the external teeth of the inner rotor 5 and the internal teeth of the outer rotor 7, the pressure applied from the discharge port 9, and the driving force of the inner rotor 5. While in this operation, the groove 13, 13A, 13B, 13C, which enlarges the clearance, increases the thickness of the oil film in the first suction region B2, and therefore the repellent force generated by the oil film between the outer rotor 7 and the inner wall 12 is decreased. As the thickness of the oil film increases, the oil film collapses, by which the repellent force is absorbed, thereby reducing the repellent force (the repellent force is weakened because interference by the oil film is great). On the other hand, as the thickness of the oil film decreases, the oil film is less likely to collapse and therefore the repellent force is not absorbed and becomes great. In other words, the thickness of the oil film is inversely proportional to the repellent force. As the clearance between the outer rotor 7 and the inner wall 12 decreases in the direction in which the outer rotor 7 is pressed, the position of the outer rotor 7 with respect to the housing 3 is adjusted, so that behavior of the outer rotor 7 is stabilized, which may result in avoiding phenomena such as the oil whirl of the outer rotor 7 from occurring.

The area where the outer rotor 7 and the inner wall 12 face each other and contact each other via the oil film is secured because the groove 13, 13A, 13B, 13C is not provided in the second suction region B3. Consequently, the deterioration of discharge performance of the internal gear pump 1, which occurs when the oil that should be discharged from the discharge path leaks to the groove 13, 13A, 13B, 13C, may be avoided. As a result, the behavior of the outer rotor 7 may be further stabilized.

According to the embodiments, the portion, where the groove 13, 13B is provided, includes the stepped portion 15 extending in the stepwise from the wall portion of the groove 13, 13B towards the outer rotor 7 with respect to the groove inner wall, which extends in the rotating direction of the outer rotor 7, as viewed in an axial cross-sectional direction relative to the second rotational axis 6.

As the stepped portion 15, which extends from the wall portion of the groove 13, 13B towards the outer rotor 7, is formed at the groove 13, 13B, the outer rotor 7 contacts the stepped portion 15 via the oil film. Consequently, the repellent force generated by the oil film may be controlled by adjusting a range of the stepped portion 15, and the position of the outer rotor 7 relative to the housing 3 may be adjusted, thereby further stabilizing the behavior of the outer rotor 7.

According to the embodiments, the groove 13, 13A may be formed to be directly in communication with the suction path 10.

Accordingly, as the groove 13, 13A is directly in communication with the suction path 10, even when the foreign substance enters the groove 13, 13A, the foreign substance may be discharged to the suction path 10.

According to the embodiments, the groove 13B, 13C may be formed to be in communication with the suction path 10 via the suction port 8.

Accordingly, because the groove 13B, 13C is not directly in communication with the suction path 10, the oil may be retained in the groove 13B, 13C, so that the oil stored in the groove 13B, 13C may be used to lubricate the internal gear pump 1 when the oil film is likely to be broken such as when the engine is started. As a result, the frictional wear of the outer circumference of the outer rotor 7 may be avoided.

The invention claimed is:

1. An internal gear pump comprising:

a housing having a pump chamber;

an inner rotor arranged in the pump chamber, rotating about a first rotational axis and having external teeth on an outer end thereof;

an outer rotor arranged in the pump chamber, rotating about a second rotational axis and having internal teeth on an inner end thereof;

a suction port that is formed at the housing and through which a fluid is sucked into the pump chamber;

a discharge port that is formed at the housing and through which the fluid is discharged from the pump chamber;

a suction path in communication with the suction port; and a discharge path in communication with the discharge port, wherein the pump chamber includes an inner wall extending in a rotating direction of the outer rotor, the inner wall includes a suction region located close to the suction port with respect to a boundary, which is a plane including the first rotational axis and the second rotational axis, and a discharge region located close to the discharge port with respect to the boundary, the suction region includes a first suction region extending in a circumferential direction towards the suction path from a pressing point, which is located at a position in the suction region and where the outer rotor is pressed by a resultant force of an inter-teeth pressure generated between the external teeth of the inner rotor and the internal teeth of the outer rotor, a pressure applied from the discharge port and a driving force of the inner rotor when the internal gear pump is in operation, and a second suction region located between the first suction region and the discharge region, a groove that enlarges a clearance between the outer rotor and the inner wall is formed at least at a portion of the first suction region, the groove is not formed in the second suction region, and a stepped portion is provided in the groove and extends stepwise towards the outer rotor from a wall portion of the groove which extends in the rotating direction of the outer rotor, as viewed in an axial cross-sectional direction relative to the second rotational axis, and a gap is formed between the outer rotor and the stepped portion.

2. The internal gear pump according to claim 1, wherein the groove is directly in communication with the suction path.

3. The internal gear pump according to claim 1, wherein the groove is in communication with the suction path via the suction port.

4. The internal gear pump according to claim 1, wherein a plurality of discharge paths are in communication with the discharge port.

* * * * *